US009865930B1

(12) United States Patent
Tonn

(10) Patent No.: US 9,865,930 B1
(45) Date of Patent: Jan. 9, 2018

(54) SLOTTED ANTENNA WITH ANISOTROPIC MAGNETIC LOADING

(71) Applicant: David A Tonn, Charlestown, RI (US)

(72) Inventor: David A Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 58 days.

(21) Appl. No.: 15/220,688

(22) Filed: Jul. 27, 2016

(51) Int. Cl.

| | |
|---|---|
| ***H01Q 13/10*** | (2006.01) |
| ***H01Q 13/12*** | (2006.01) |
| ***H01Q 1/48*** | (2006.01) |
| ***H01Q 1/36*** | (2006.01) |

(52) U.S. Cl.
CPC ..... *H01Q 13/12* (2013.01); *H01Q 1/36* (2013.01); *H01Q 1/48* (2013.01)

(58) Field of Classification Search
CPC ..... H01Q 13/10; H01Q 13/18; H01Q 21/24; H01Q 1/36; H01Q 1/48; H01Q 13/12
See application file for complete search history.

(56) References Cited

U.S. PATENT DOCUMENTS

| | | | | |
|---|---|---|---|---|
| 2,460,286 A * | 2/1949 | Hansen | H01Q 13/18 | 343/767 |
| 2,791,769 A * | 5/1957 | Nils | H01Q 13/10 | 343/769 |
| 4,536,714 A * | 8/1985 | Clark | H01Q 1/52 | 324/338 |
| 9,000,996 B2 * | 4/2015 | Holland | H01Q 9/28 | 343/700 MS |
| 2005/0104782 A1 * | 5/2005 | Peled | H01Q 1/241 | 343/702 |

* cited by examiner

*Primary Examiner* — Tho G Phan
(74) *Attorney, Agent, or Firm* — James M. Kasischke; Michael P. Stanley

(57) ABSTRACT

An antenna can be joined to an antenna feed and positioned perpendicular to a ground plane. The antenna includes a conductive radiator having a cylindrical portion. A slot is formed in the entire length of the cylindrical portion. Two parallel fins extend from the cylindrical portion at the slot. The fins can extend inwardly or outwardly. The antenna feed is connected to the conductive radiator on either side of the slot. An anisotropic magnetic material having a uniaxial permeability tensor is positioned in the slot between the two fins. This material is oriented such that it has a much greater permeability in the radial direction than in the other directions. The interior of the cylindrical portion can be filled with a dielectric material.

11 Claims, 5 Drawing Sheets

SLOTTED ANTENNA WITH ANISOTROPIC MAGNETIC LOADING

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention is directed to a slotted antenna having enhanced broadband characteristics.

(2) Description of the Prior Art

Slotted cylinder antennas are popular antennas for use in line of sight communications systems, especially where the carrier frequency exceeds 300 MHz. FIG. 1 provides a diagram of a prior art slotted cylinder antenna 10. Antenna 10 includes a metallic cylinder 12 having slot 14 cut into the wall of the cylinder 12. Cylinder 12 can be any thickness as long as skin effects are avoided. Slot 14 is parallel to an axis 16 of cylinder 12. Axis 16 is perpendicular to a ground plane 18. In the antenna shown, slot 14 extends the entire length of the cylinder 12. The interior of the cylinder or cavity is typically filled with air but another dielectric material can be used. FIG. 1 shows an end-fed version of this antenna, but this antenna can also be center-fed. In the end-fed version, a transmission line having a first conductor 20 is provided through the ground plane 18 and connected across the slot 14 near one end of the slot 14. A second conductor 22 is shown grounded to the ground plane 18. Transmission line can be either a balanced line, such as a twisted pair, or an unbalanced line, such as a length of coaxial line (shown). In either case, the feeding transmission line 22 has two conductors in order to connect across slot 14. The optimal frequency of this antenna 10 is given by the length of the slot 14. The size of the cavity and the slot width govern bandwidth.

FIG. 2 shows a computed voltage standing wave ratio (VSWR) for this antenna. The VSWR is a figure of merit used in determining the impedance bandwidth of the antenna. Typically this bandwidth is the continuous range of frequencies for which VSWR <3:1. For the example shown in FIG. 2, resonant character of the antenna can be seen in the oscillatory nature of the VSWR curve, and modest bandwidth in each passband.

SUMMARY OF THE INVENTION

It is a first object of the present invention to provide a compact antenna capable of transmitting and receiving.

Another object is to provide such an antenna having a bandwidth of at least one octave.

One particular object is to provide an antenna for use in the commercial VHF radio band.

Yet another object is to provide an antenna design that can be scaled to different radio bands.

Accordingly, there is provided an antenna that can be joined to an antenna feed and positioned perpendicular to a ground plane. The antenna includes a conductive radiator having a cylindrical portion. A slot is formed in the entire length of the cylindrical portion. Two parallel fins extend from the cylindrical portion at the slot. The fins can extend inwardly or outwardly. The antenna feed is connected to the conductive radiator on either side of the slot. An anisotropic magnetic material having a uniaxial permeability tensor is positioned in the slot between the two fins. This material is oriented such that it has a much greater permeability in the radial direction than in the other directions. The interior of the cylindrical portion can be filled with a dielectric material.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

Figure 1:
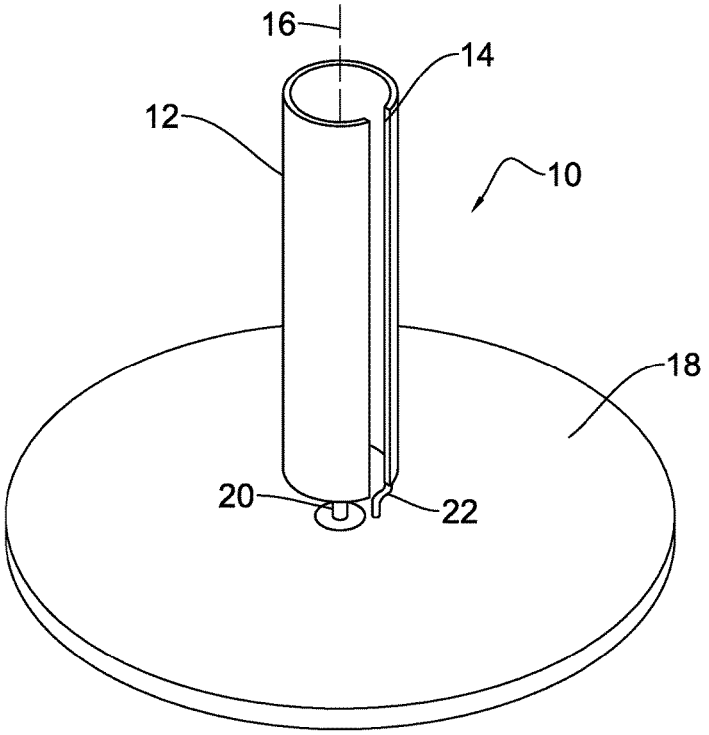
FIG. 1 (PRIOR ART)
FIG. 1 is a perspective view of a prior art antenna.
Figure 2:
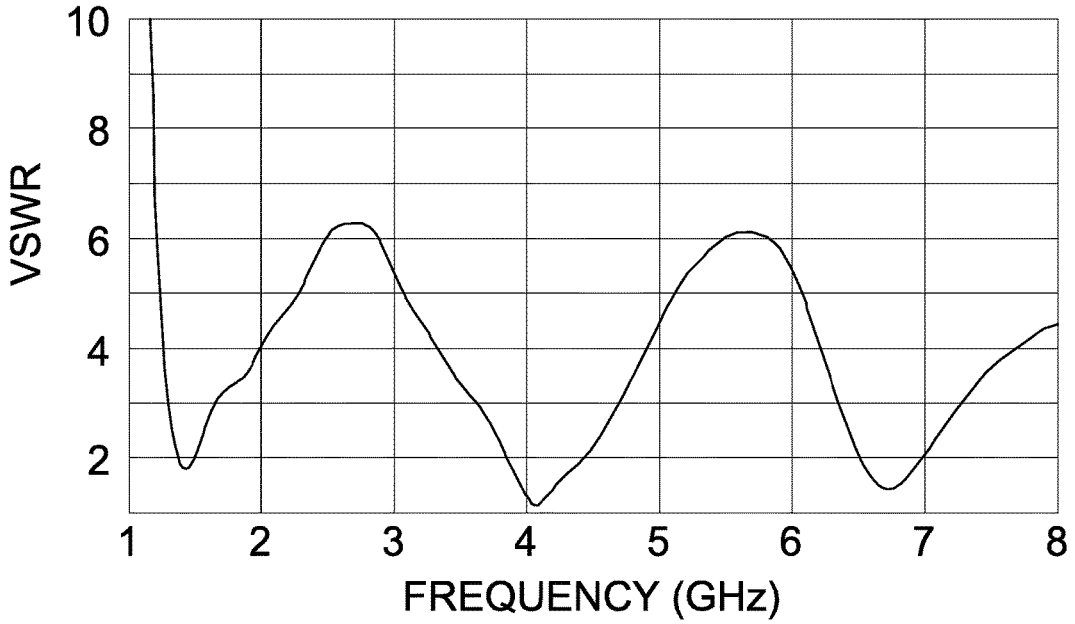
FIG. 2 is a modeled plot of VSWR against frequency of the prior art antenna.
Figure 3:
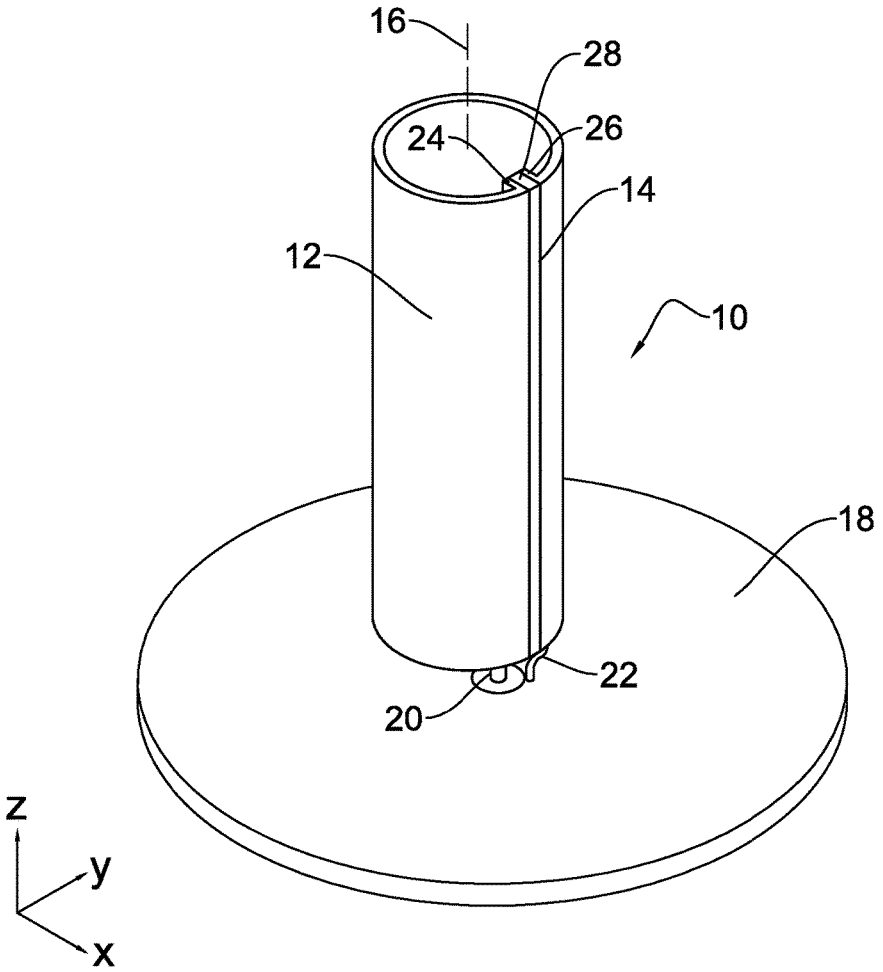
FIG. 3 is a perspective view of an antenna embodiment in accordance with the current invention.

FIG. 3 shows a perspective view of an embodiment of the antenna 10. Antenna 10 includes a cylindrical radiator 12 having a slot 14 formed longitudinally therein parallel to an axis 16 of cylindrical radiator 12. Ground plane 18 should be electrically small (less than ⅕ wavelength) in diameter or on average. Opposed fins 24 and 26 are positioned on opposite sides of slot 14. Fins 24 and 26 are parallel and directed inward, parallel to a radius of cylindrical radiator 12. The volume of slot 14 between fins 24 and 26 is filled with an anisotropic magnetic material 28 with a uniaxial permeability tensor. This means that the material is strongly polarized in one direction and weakly polarized in other directions. If the plane of one of the fins is parallel to the x-z coordinate plane, the material parameters required for proper orientation of the anisotropic magnetic material 28 are $\mu_{yy}=\mu_{zz}=1$, $\mu_{xx}>8$ with a uniaxial dielectric tensor. Thus, properties are different through the radial depth of the anisotropic magnetic material. The coordinate axis used is shown in the lower left corner of the FIG. Using this coordinate system, the radial direction is parallel to the x axis, the transverse direction is parallel to the y axis, and the longitudinal direction is parallel with the z axis.

Cylindrical radiator 12 is positioned above and electrically isolated from a ground plane 18. A coaxial feed is shown having a first element 20 and a second element 22 in contact with radiator 12 and positioned across slot 14. First element 20 is positioned on one side of slot 14, and second element 22 is positioned on an opposite side of slot 14.

Figure 4:
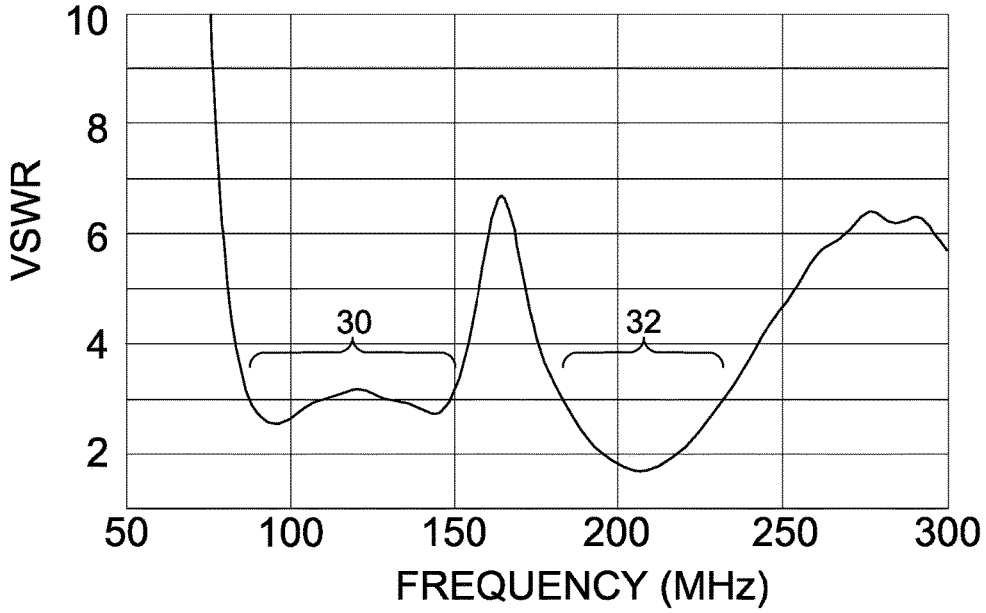
FIG. 4 is a modeled plot of VSWR against frequency of an antenna without anisotropic magnetic material.

FIG. 4 shows a modeled VSWR plot of an antenna having a slotted cylindrical shell like that of the antenna 10 shown in FIG. 3 but without anisotropic magnetic material positioned between the fins 24 and 26. This plot shows a first passband at 30 and a second passband at 32. The first passband has a bandwidth ratio of approximately 1.87:1. (The small region near 120 MHz where VSWR is slightly >3 is included in the first passband.)

Figure 5:
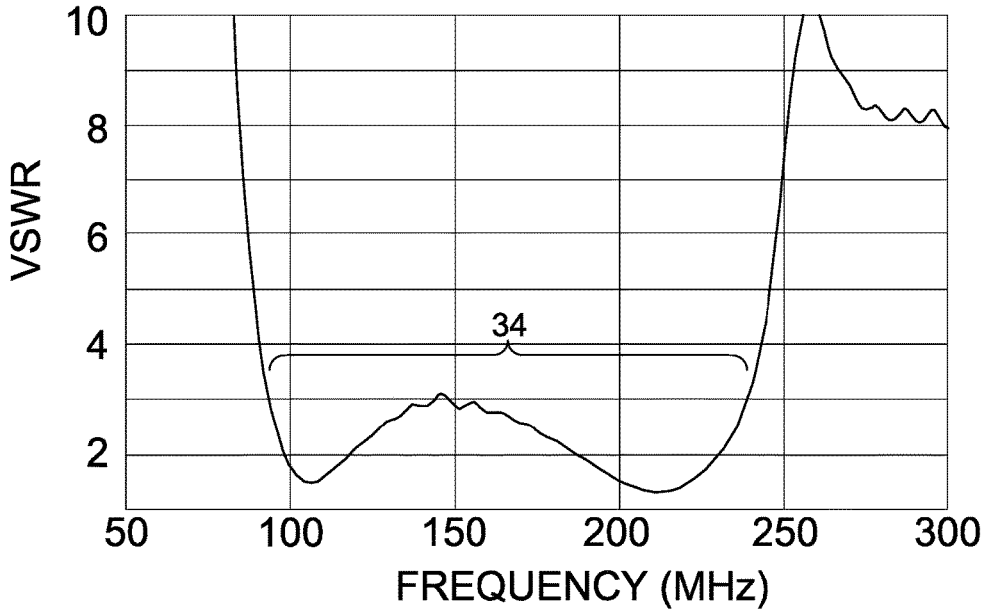
FIG. 5 is a modeled plot of VSWR against frequency of the antenna embodiment shown in FIG. 3.

FIG. 5 provides a modeled VSWR plot of an antenna having a slotted cylindrical shell with anisotropic magnetic material positioned in the slot. The anisotropic magnetic material had a $\mu_{xx}=10$ with the other components all equaling unity. This plot shows a single passband 34 with a roughly 3:1 bandwidth.

Figure 6:
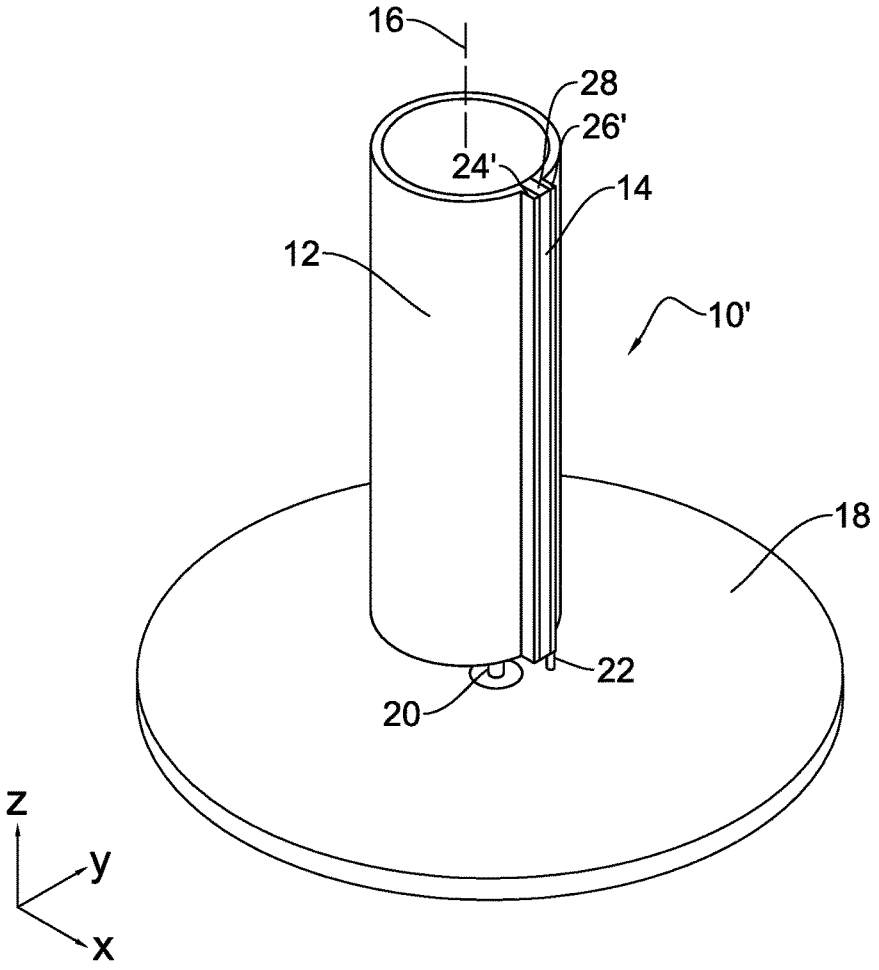
FIG. 6 is a perspective view of an alternative antenna embodiment.

FIG. 6 provides a perspective view of an alternative embodiment 10' of the antenna. As with the first embodiment antenna 10' includes a cylindrical radiator 12 having a slot 14 formed longitudinally therein parallel to an axis 16 of cylindrical radiator 12. Opposed fins 24' and 26' are positioned on opposite sides of slot 14. Fins 24 and 26 are parallel and directed outward, parallel to a radius of cylindrical radiator 12. Slot 14 between fins 24' and 26' is filled with an anisotropic magnetic material 28 with a uniaxial permeability tensor. The planes of the fins are parallel to the x-z coordinate plane. The anisotropic magnetic material 28 permeabilities are $\mu_{yy}=\mu_{zz}=1$, $\mu_{xx}>8$ with a uniaxial permeability tensor. As before, cylindrical radiator 12 is positioned above and electrically isolated from a ground plane 18. Coaxial feed has elements 20 and 22 in contact with radiator 12 and positioned across slot 14. The interior region of cylindrical shell 12 can be filled with a dielectric material that doesn't interfere with the electrical or magnetic properties of the antenna. Syntactic foam could be used for this.

One possible application of this antenna is in digital television and cellular communications towers. The broader bandwidth of this type of antenna will allow usage of a single antenna by a user with different services. As a relatively compact antenna, this can also be used for mast mounted antennas. Its characteristics may help simplify the tuning electronics in legacy radio applications.

This antenna has further advantages in terms of polarization. Normally, a vertically disposed slot antenna will produce a radiation field that is horizontally polarized. In the case of the present invention, vertical polarization is predicted by the current modeling. Modeling indicates a theta component to the radiated field that is one order of magnitude larger than the phi component in the x-y plane.

Figure 7A:
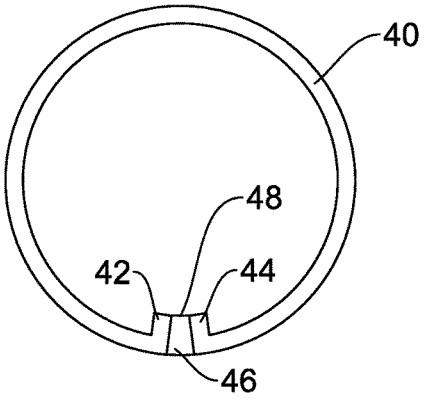
FIG. 7A is a top view of an embodiment of the cylindrical shell.
Figure 7B:
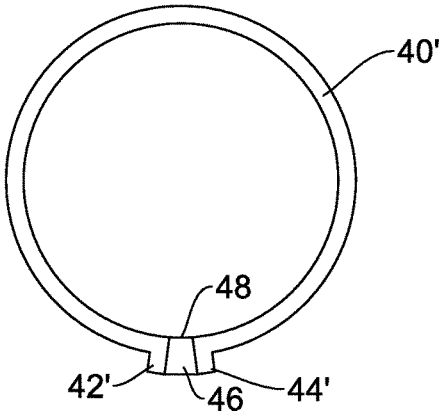
FIG. 7B is another view of an embodiment of the cylindrical shell.
Figure 7C:
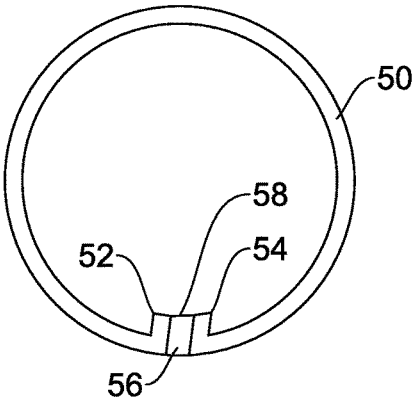
FIG. 7C is yet another view of an embodiment of the cylindrical shell.

It will be understood that many additional changes in the details, materials, steps and arrangement of parts, which have been herein described and illustrated in order to explain the nature of the invention, may be made by those skilled in the art within the principle and scope of the invention as expressed in the appended claims. For example, fins can be truly radial or otherwise positioned as long as they are not close enough to each other to cause capacitive coupling. This is shown in the top view of cylindrical radiator given in FIG. 7A and FIG. 7B. In FIG. 7A, shell 40 has opposed fins 42 and 44 on either side of slot 46. Fins 42 and 44 are not parallel to each other and are oriented radially inward. As before, an anisotropic magnetic material 48 with a uniaxial permeability tensor is positioned between fins 42 and 44. FIG. 7B has a shell 40' with opposed fins 42' and 44' positioned on either side of a slot 46. Anisotropic magnetic material is positioned in the slot, between fins 42' and 44'. Opposed fins 42' and 44' in this embodiment extend radially outward from shell 40'. In FIG. 7C, the embodiment has a cylinder 50 having fins 52 and 54. Fins 52 and 54 extend inward in a general direction and are generally opposed. Anisotropic magnetic material 58 is positioned in slot 56. It is thus shown that fins can be oriented at different angles to the axis of a cylinder, and the fins do not need to be parallel to one another.

The foregoing description of the preferred embodiments of the invention has been presented for purposes of illustration and description only. It is not intended to be exhaustive, nor to limit the invention to the precise form disclosed; and obviously, many modification and variations are possible in light of the above teaching. Such modifications and variations that may be apparent to a person skilled in the art are intended to be included within the scope of this invention as defined by the accompanying claims.

What is claimed is:

1. An antenna capable of being joined to an antenna feed perpendicular to a ground plane comprising:

a conductive radiator having a cylindrical portion with a slot formed therein from a first end to a second end of the cylindrical portion parallel to an axis of the cylindrical portion, said conductive radiator further having two parallel fins extending from the cylindrical portion at the slot, the fins being further parallel to a radius of the cylindrical portion intermediate the slot, the antenna feed being connectable to the conductive radiator adjacent to and across the slot; and an anisotropic magnetic material having a uniaxial permeability tensor positioned in said conductive radiator slot between the two parallel fins and oriented such that the anisotropic magnetic material has a much greater permeability in the radial direction parallel to the radius intermediate the slot than in the longitudinal direction and the transverse direction.

2. The apparatus of claim 1 wherein said anisotropic magnetic material is made from a material having a permeability tensor of the form:

$$\bar{\mu}=\begin{pmatrix}\mu_{xx} & 0 & 0\\ 0 & \mu_{yy} & 0\\ 0 & 0 & \mu_{zz}\end{pmatrix}$$

wherein $\mu_{yy}=\mu_{zz}=1$ and $\mu_{xx}$ is at least 8, wherein x is in the radial direction, y is in the transverse direction and z is in the longitudinal direction.

3. The apparatus of claim 1 wherein the conductive radiator two parallel fins extend inwardly into the conductive radiator cylindrical portion.

4. The apparatus of claim 1 wherein the conductive radiator two parallel fins extend outwardly beyond a conductive radiator cylindrical portion exterior.

5. The apparatus of claim 1 wherein an interior of the conductive radiator cylindrical portion is filled with a non-magnetic, dielectric material.

6. The apparatus of claim 5 wherein the non-magnetic dielectric material is syntactic foam.

7. An antenna capable of being joined to an antenna feed perpendicular to a ground plane comprising:

a conductive radiator having a cylindrical portion with a slot formed therein from a first end to a second end of the cylindrical portion parallel to an axis of the cylindrical portion, said conductive radiator further having two fins extending from the cylindrical portion at the slot, the fins being generally opposed to one another across the slot, the antenna feed being connectable to the conductive radiator adjacent to and across the slot; and an anisotropic magnetic material having a uniaxial permeability tensor positioned in said conductive radiator slot between the two fins and oriented such that the anisotropic magnetic material has a much greater permeability in the radial direction parallel to a radius intermediate the slot than in the longitudinal direction and the transverse direction.

8. The apparatus of claim 7 wherein the fins are parallel to one another.

9. The apparatus of claim 8 wherein the fins are further parallel to the radius of the cylindrical portion, intermediate the slot.

10. The apparatus of claim 7 wherein the fins are radially disposed with respect to the cylindrical portion, each fin being disposed on a different radius.

11. The apparatus of claim 7 wherein the ground plane has a general diameter less than ⅕ wavelength of a design frequency of the antenna.

* * * * *